US009206961B1

(12) United States Patent
Bastiani et al.

(10) Patent No.: US 9,206,961 B1
(45) Date of Patent: Dec. 8, 2015

(54) LED ELEVATED LIGHT FIXTURE AND METHOD

(71) Applicant: D M E Corporation, Ft. Lauderdale, FL (US)

(72) Inventors: Sergio Bastiani, Fort Lauderdale, FL (US); Jerome Brown, Fort Lauderdale, FL (US)

(73) Assignee: D M E Corporation, Ft. Lauderdale, FL (US)

( * ) Notice: Subject to any disclaimer, the term of this patent is extended or adjusted under 35 U.S.C. 154(b) by 0 days.

(21) Appl. No.: 14/559,901

(22) Filed: Dec. 3, 2014

Related U.S. Application Data

(60) Provisional application No. 61/911,267, filed on Dec. 3, 2013.

(51) Int. Cl.

| | |
|---|---|
| ***H05B 37/02*** | (2006.01) |
| ***F21V 13/10*** | (2006.01) |
| ***H05B 33/08*** | (2006.01) |
| ***F21V 7/04*** | (2006.01) |
| ***F21V 13/08*** | (2006.01) |
| *F21W 111/06* | (2006.01) |
| *F21Y 101/02* | (2006.01) |

(52) U.S. Cl.
CPC . *F21V 13/10* (2013.01); *F21V 7/04* (2013.01); *F21V 13/08* (2013.01); *H05B 33/089* (2013.01); *F21W 2111/06* (2013.01); *F21Y 2101/02* (2013.01)

(58) Field of Classification Search
CPC ..... H05B 37/02; H05B 33/0848; B64F 1/20; F21W 2111/06
USPC ..... 326/76, 120
See application file for complete search history.

(56) References Cited

U.S. PATENT DOCUMENTS

| | | | | |
|---|---|---|---|---|
| 2008/0164822 | A1* | 7/2008 | Serebryanov et al. | 315/129 |
| 2009/0303084 | A1* | 12/2009 | Tartock et al. | 340/953 |
| 2011/0180824 | A1* | 7/2011 | Tan et al. | 257/89 |
| 2013/0094192 | A1* | 4/2013 | De Boeck et al. | 362/145 |
| 2013/0329434 | A1* | 12/2013 | Packard et al. | 362/311.01 |

* cited by examiner

*Primary Examiner* — Don Le
(74) *Attorney, Agent, or Firm* — Hodgson Russ LLP

(57) ABSTRACT

Disclosed are elevated lights and methods of maintaining illumination in elevated lights for an airfield. The elevated lights have a substrate having a mounting surface, LEDs, a reflector, and an LED driver circuit. The LEDs are disposed on the mounting surface of the substrate and configured such that a primary illumination axis of each LED is oriented along a longitudinal axis of the elevated light. The reflector is configured such that the light emitted from the LEDs is reflected radially with respect to the longitudinal axis of the elevated light. The driver circuit is configured to provide a current to the LEDs and detect failure of one or more of the LEDs. Illumination is maintained by providing a current to the LEDs, detecting a voltage change across the LEDs, determining, based on the voltage change, LED failure, and altering the provided electrical current in order to maintain illumination.

19 Claims, 10 Drawing Sheets

LED ELEVATED LIGHT FIXTURE AND METHOD

CROSS-REFERENCE TO RELATED APPLICATIONS

This application claims priority to U.S. Provisional Application No. 61/911,267, filed on Dec. 3, 2013, the disclosure of which is incorporated herein by reference.

FIELD OF THE INVENTION

The invention relates to airfield light fixtures.

BACKGROUND OF THE INVENTION

Elevated light fixtures are commonly used in airfield lighting to delineate runways, taxiways, thresholds, etc. Such uses of light fixtures may require certification of compliance with governmental specifications such as the U.S. Federal Aviation Administration's "Specification for Runway and Taxiway Light Fixtures" (AC 150/5345-46). Previous elevated lighting often utilized quartz-halogen or other conventional light sources. However, such conventional light sources require significant power for operation (e.g., 45 W per fixture) and are susceptible to damage caused by, for example, vibration. As such, there is a need for more resilient light fixtures that are able to meet governmental specifications for use in airfields.

BRIEF SUMMARY OF THE INVENTION

One embodiment of the present invention may be described as an elevated light for an airfield comprising a substrate having a mounting surface, two or more light-emitting diodes ("LEDs"), a reflector, and an LED driver circuit.

The two or more LEDs may be disposed on the mounting surface of the substrate. In one embodiment, the two or more LEDs comprises six LEDs. The LEDs may be configured such that a primary illumination axis of each LED is oriented along a longitudinal axis of the elevated light. In one embodiment, the two or more LEDs are connected in serial with one another. In another embodiment, at least one of the LEDs has a different chromaticity from that of another of the LEDs.

The reflector may be affixed to the substrate. The reflector may have a reflecting surface configured such that the light emitted from the LEDs is reflected radially with respect to the longitudinal axis of the elevated light. The reflector may be affixed to the substrate substantially at a center of the substrate. The reflecting surface may be partially transmissive.

The LED driver circuit may be configured to provide a current to the LEDs and detect failure of one or more of the LEDs by detecting a voltage drop. In one embodiment, the LED driver circuit does not contain a voltage regulator. In such an embodiment, a rail voltage of the LED driver circuit varies as a function of the number of LEDs in the string and the forward voltage of each LED. In one embodiment, the elevated light further comprises a series resistor configured to regulate an electrical current provided to the LEDs.

In another embodiment, the LED driver circuit further comprises a MOSFET configured to ground the circuit in the case of an overvoltage condition. In such an embodiment, the LED driver circuit may further comprise one or more capacitors and a blocking diode between the MOSFET and the one or more capacitors. In one embodiment, the elevated light may further comprise an additional MOSFET positioned in series with the LEDs. The additional MOSFET may be configured to reduce a pulse-width modulation signal provided to the LEDs.

In one embodiment, the elevated light may further comprise a baffle arranged such that light from at least one of the LEDs is not directed to at least one other of the LEDs. In another embodiment, the baffle bisects the reflecting surface of the reflector. The baffle may conform to the shape of an inside surface of the cover.

In another embodiment, the elevated light further comprising an optically transmissive cover. The cover may be configured to filter light emitted from the LEDs.

The present invention may also be described as an elevated light for an airfield comprising a substrate having a mounting surface, six light-emitting diodes, a reflector, a baffle, and an optically transmissive cover at least partially enclosing the LEDs, the reflector, and the baffle.

The six LEDs are disposed on the mounting surface of the substrate and are configured such that a primary illumination axis of each LED is oriented along a longitudinal axis of the elevated light. The LEDs are serially connected with one another.

The reflector is affixed to the substrate and is configured such that the light emitted from the LEDs is reflected radially with respect to the longitudinal axis of the elevated light.

The baffle bisects the reflecting surface of the reflector and is arranged such that light from three of the LEDs having a first chromaticity is not directed to the other three LEDs having a second chromaticity.

The present invention may also be described as a method of maintaining illumination in an elevated light for an airfield. In such a method, the elevated light has two or more serially-connected light-emitting diodes ("LEDs") each having a primary illumination axis and a reflector. The method comprising the step of orienting the two or more LEDs such that the primary illumination axis of each LED is along a longitudinal axis of the elevated light.

The method further comprises the step of orienting the reflector such that light emitted from each of the two or more LEDs is reflected radially with respect to the longitudinal axis of the elevated light.

The method further comprises the steps of providing an electrical current to the two or more LEDs using an LED driving circuit and detecting, using a microprocessor, a voltage change across the two or more LEDs. In one embodiment, the method further comprises the step of signaling an alarm when the failure of one or more of the LEDs is determined.

The method further comprises the step of determining, based on the voltage change, a failure of one or more of the LEDs. And the method further comprises the step of altering the provided electrical current in order to maintain illumination in the elevated light after the failure of one or more of the LEDs.

DESCRIPTION OF THE DRAWINGS

For a fuller understanding of the nature and objects of the invention, reference should be made to the following detailed description taken in conjunction with the accompanying drawings, in which.

DETAILED DESCRIPTION OF THE INVENTION

Figure 4:
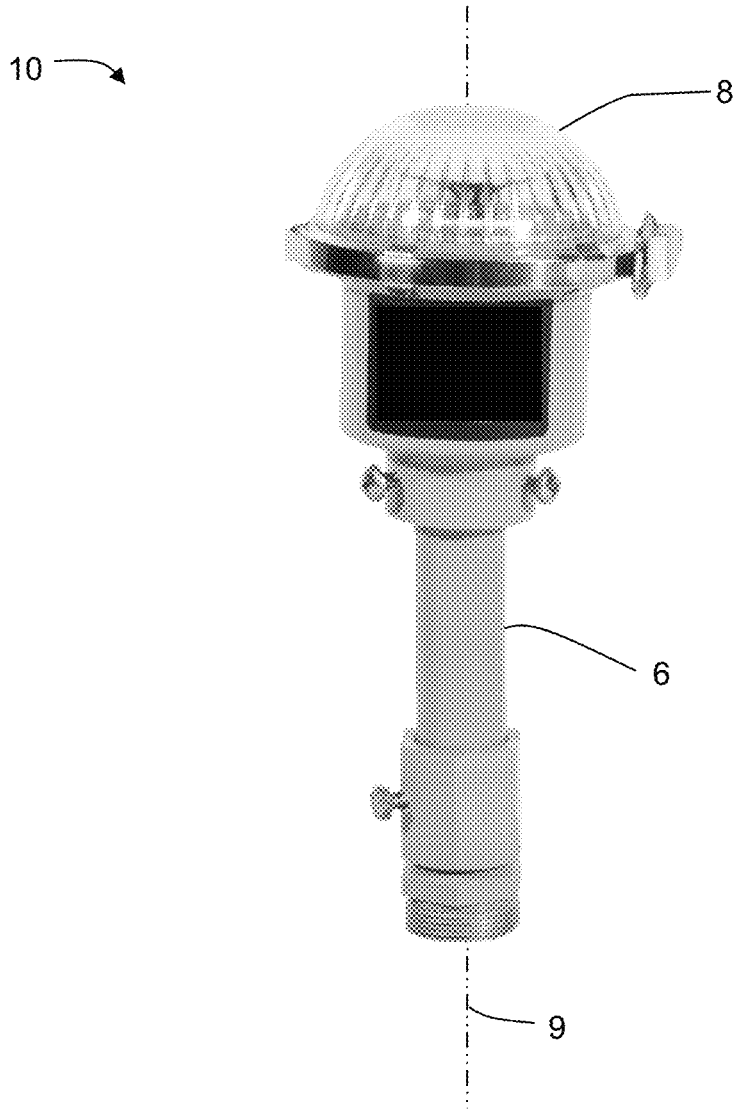
FIG. 4 is a perspective view of a light fixture according to another embodiment of the present invention.

Referring now to FIG. 4, the present disclosure may be embodied as an elevated light 10 for an airfield. Such light fixtures are known for use in delineating the edges of airfield runways, thresholds, and taxiways. The light 10 may be generally configured as a pedestal light wherein a housing 6 of the light is elongate in order to elevate the illuminating portion 8 of the light 10 above the ground. In this configuration, the light 10 may be considered to have a longitudinal axis 9. The disclosed light 10 has light-emitting diode ("LED") illumination such that improvements may be achieved in required power (reduced) and reliability (increased) over conventional elevated lighting.

Figure 2A:
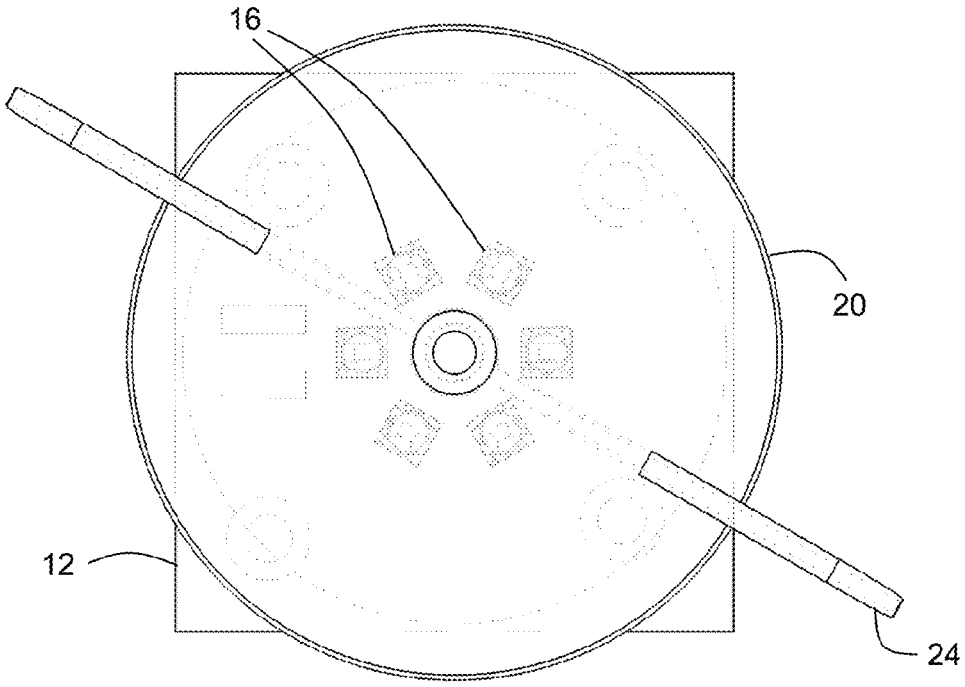
FIG. 2A is a top view diagram of a portion of a light fixture according to another embodiment of the present invention.
Figure 2B:
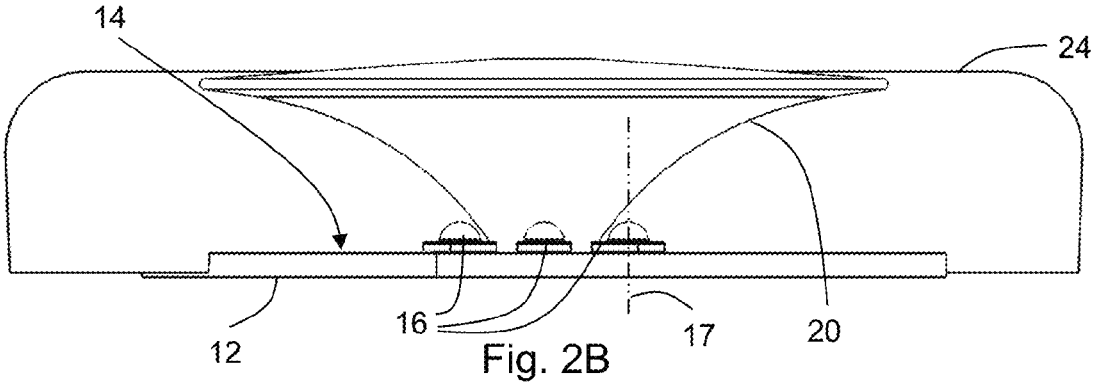
FIG. 2B is a side view diagram of the light fixture portion of FIG. 2A.

With reference to FIGS. 2A and 2B, the light 10 has a substrate 12 with a mounting surface 14. Two or more LEDs 16 are mounted to the mounting surface of the substrate 12. Each LED 16 has a primary illumination axis 17 which is defined along a direction perpendicular to the LED's 16 mounting structure (a base of a typical LED component). In other configurations, the primary illumination axis 17 of each LED 16 is substantially parallel to the longitudinal axis 9 of the light 10 (which may or may not be perpendicular to the mounting surface 14). In some embodiments, the LEDs 16 are mounted on the substrate 12 such that the primary illumination axis 17 of each LED 16 is substantially perpendicular to the mounting surface 14 of the substrate 12. In one embodiment, the light 10 has six LEDs 16.

A reflector 20 is affixed to the substrate 12. The reflector 20 is configured to reflect light emitted from the LEDs in a radial direction with respect to the longitudinal axis 9 of the elevated light 10. As such, in a typical airfield application, the light emitted from an elevated light 10 is visible along a primarily horizontal direction (including light distributed throughout a range with respect to the horizon (i.e., 0°) from 0°-70° or more, including any value between). The reflector 20 may be configured so as to attach to the substrate 12 substantially at a center of the substrate 12. In this way, the reflector 20 may be arranged between the two or more LEDs 16 and configured to reflect light emitted from the LEDs 16 radially throughout the full 360° horizontal range of the light 10. Such a configuration may be referred to as an omnidirectional light. The reflector 20 may be fully reflective—reflecting substantially all of the received light, transmitting no light through the reflector 20. In other embodiments, the reflector 20 may be partially reflective—reflecting less than 100% of the received light and allowing some light to transmit through the reflector 20.

Figure 3A:
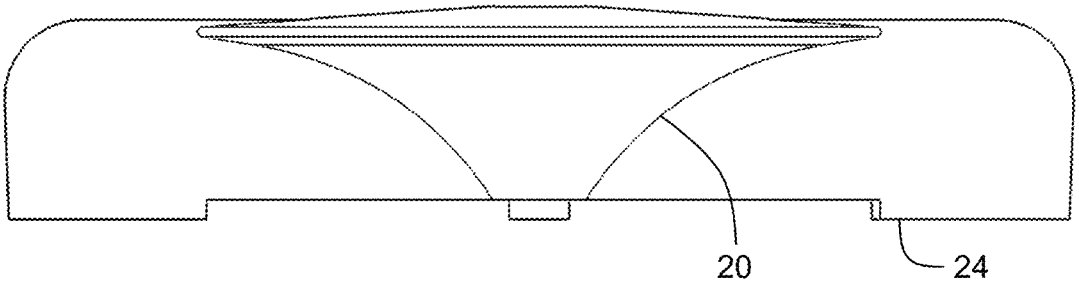
FIG. 3A is a side view diagram of a reflector and baffle of a light fixture according to an embodiment of the present invention.
Figure 3B:
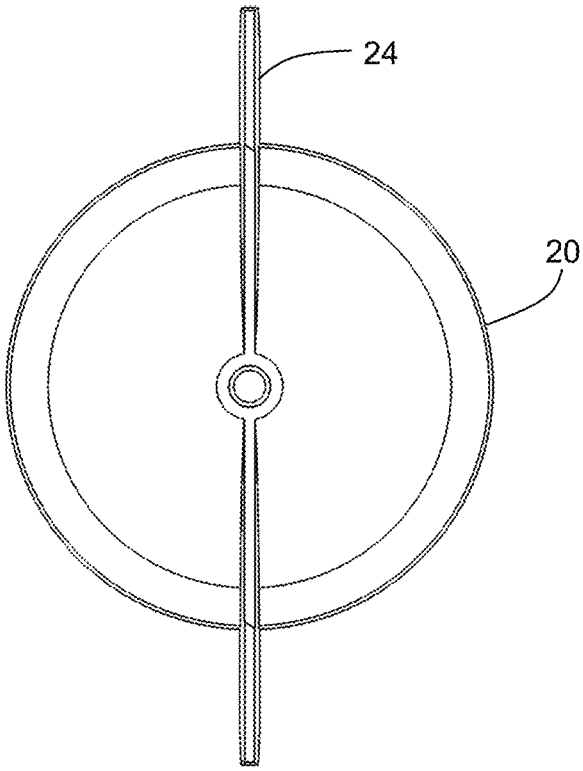
FIG. 3B is a bottom view diagram of the reflector and baffle of FIG. 3A.

The elevated light 10 may comprise a baffle 24 arranged between at least two LEDs 16. The baffle 24 separates light illuminated by the LEDs 16 such that light from at least one of the LEDs 16 is not directed to another of the LEDs 16. For example, in an embodiment with two LEDs and a reflector configured to reflect emitted light radially, a baffle may be configured such that light emitted from one of the LEDs is only radially reflected through 180° while light from the other LED is only radially reflected through the remaining 180°. The baffle 24 may be to segregate light through more than two ranges (e.g., three LEDs, each LED emitting through 120° of the total 360° range). The baffle 24 may segregate emitted light symmetrically or through any combination of horizontal ranges. In a symmetrical embodiment, the baffle 24 may bisect the reflector 20, for example, as depicted in FIG. 2A. Such an arrangement may be considered as "bi-directional." FIGS. 3A and 3B depict another example of the baffle 24 and the reflector 20 where the LEDs 16 and substrate 12 are hidden.

The LEDs 16 may have differing chromaticity. For example, in an exemplary embodiment having six LEDs 16, three LEDs 16 may have a first chromaticity (e.g., white) and the remaining three LEDs 16 may have a second chromaticity (e.g., yellow). The baffle 24 may be arranged to segregate light from the LEDs 16 according to chromaticity. In this manner, an exemplary bi-directional light 10 may have green light emitted in a first radial direction and yellow light emitted in a second radial direction. It should be noted that the LEDs 16 of differing chromaticity need not be even. For example, in a four LED light, one LED may have a first chromaticity and three may have a second chromaticity. Similarly, the LEDs need not be even separated by the baffle. For example, in a five LED example, two white LEDs may be baffled from three LEDs—two of which are yellow and one being red, thereby causing an generally orange colored light to be emitted from the three LED side of the baffle.

The light 10 may further comprise a cover 28, at least a portion of which is optically transmissive. The cover 28 is configured to partially enclose the substrate 10, LEDs 16, reflector 20, and baffle 24. The cover 28 may be configured to cooperate with the housing 6 of the light 10 in order to enclose the components of the light 10 and provide protection from weather and other externalities. The cover 28 may be tinted to filter the transmitted light. The tint may alter the chromaticity of the light transmitted through the cover 28. In other embodiments, the cover 28 has no tint and transmits light emitted from the LEDs substantially unchanged in chromaticity. The baffle 24 may be shaped such that the outer circumference of a portion of the baffle conforms to the shape of an insider surface of the cover 28.

At least two of the LEDs 16 are serially connected with each other. An LED driver circuit 30 is configured to provide a current to the LEDs 16. In this manner, each LED 16 of the series connected LEDs 16 (the "string") receives the same current. The LED driver circuit 30 may be configured with no voltage regulator such that the rail voltage of the LED string may vary. In this way, the rail voltage is a function of the number of LEDs 16 in the string and the forward voltage of each LED 16. In this configuration, and in a typical failure mode of an LED, the LED may short and the rail voltage will vary accordingly. The LED driver circuit 30 is configured to detect a variance in the rail voltage such that a failure in one or more LEDs 16 of the string will be detected. The LED driver circuit 30 may be configured to provide a signal, such as, for example, an audible alarm, to an operator. In this way, the light 10 may be repaired or replaced. This configuration provides a level of redundancy in case of a common LED failure where the LED fails as a short circuit—the light 10 will still function (but perhaps at a lower level of illumination).

Figure 1:
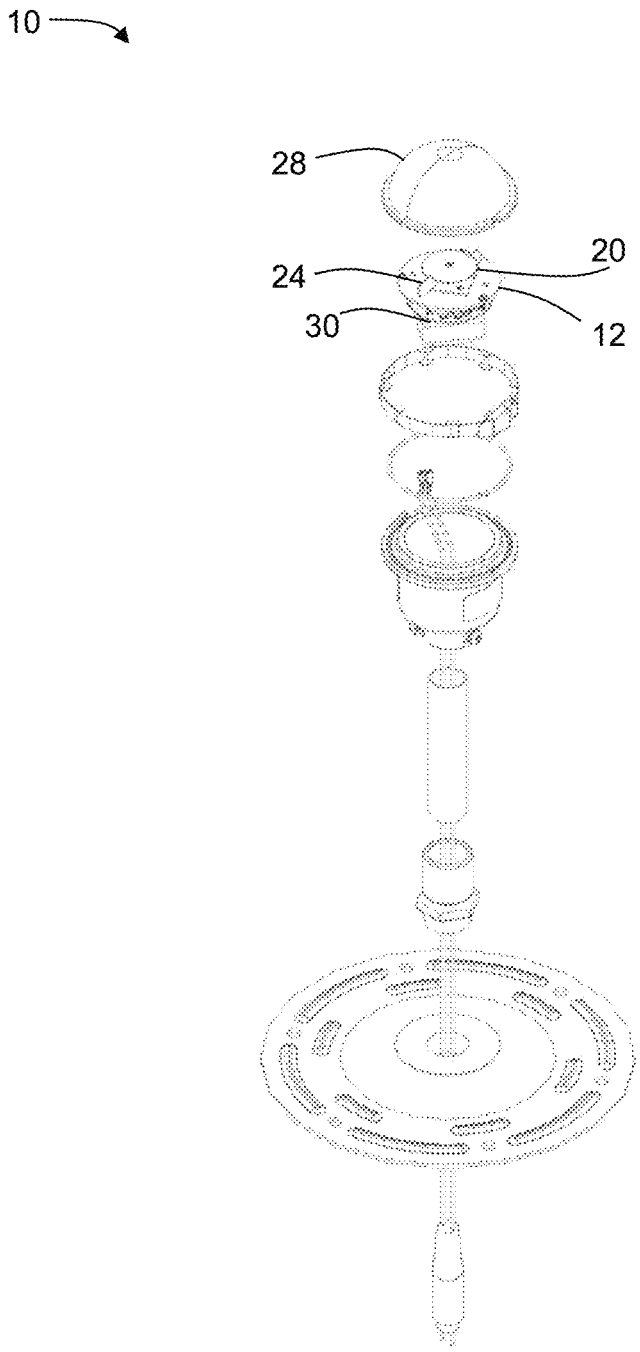
FIG. 1 is an exploded view diagram of a light fixture according to an embodiment of the present disclosure.

In a current-driven circuit with no voltage regulation, overvoltage may be problematic. FIG. 1 shows an exploded view of one embodiment of the invention containing an LED driver circuit 30. The LED driver circuit 30 may comprise an overvoltage protection circuit (i.e., a crowbar circuit) such as, for example, a MOSFET grounding the circuit in the case of an overvoltage condition (e.g., short failure of multiple LEDs in a string). A blocking diode (such as, for example, a Schottky diode) may be provided between the crowbar circuit and capacitors of the circuit such that the capacitors do not discharge when the circuit is grounded through the MOSFET.

The LED current of the LED driver circuit 30 may be limited and monitored by manipulation of an RC time constant provided between a capacitor and the LED string. In this way, increasing or decreasing the short will change the time constant. This time constant, along with the source current will determine how much current the LEDs 16 will receive (i.e., the intensity of the LEDs 16). The LED current is regulated using a series resistor. By monitoring the voltage across this series resistor, using, for example, an analog port of a microcontroller making up part of the LED driver circuit 30, and knowing the resistance of the resistor, the current through the series string may be determined.

When low light intensity is desired, the above-described RC time constant manipulation may not sufficiently control the LEDs 16. Additionally, the LEDs 16 may flicker (i.e., rapidly vary in intensity). To adequately address low intensity LED operation, the LED drive circuit 30 may comprise an additional MOSFET in line with the LED string and reducing the pulse-width modulation signal to the MOSFET in order to reduce the input setting of the LEDs 16. Such a configuration has been tested to achieve the desired low intensity light while also reducing the visible flicker in the LEDs 16.

FIGS. 5A-5E depict a circuit diagram for an elevated airfield light according to one embodiment of the present invention. For convenience, the circuit diagram has been further divided into circuit subsections. The circuit subsections may not represent complete circuit modules and are used only for reference purposes.

Figure 5A:
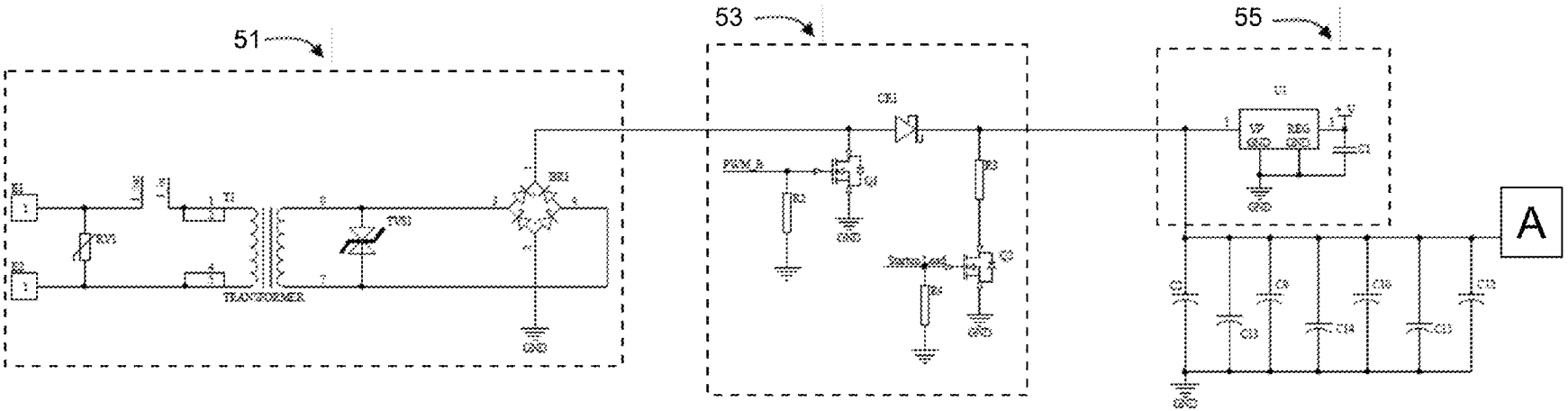
FIGS. 5A-E are schematics of a light fixture according to another embodiment of the present invention.
Figure 5B:
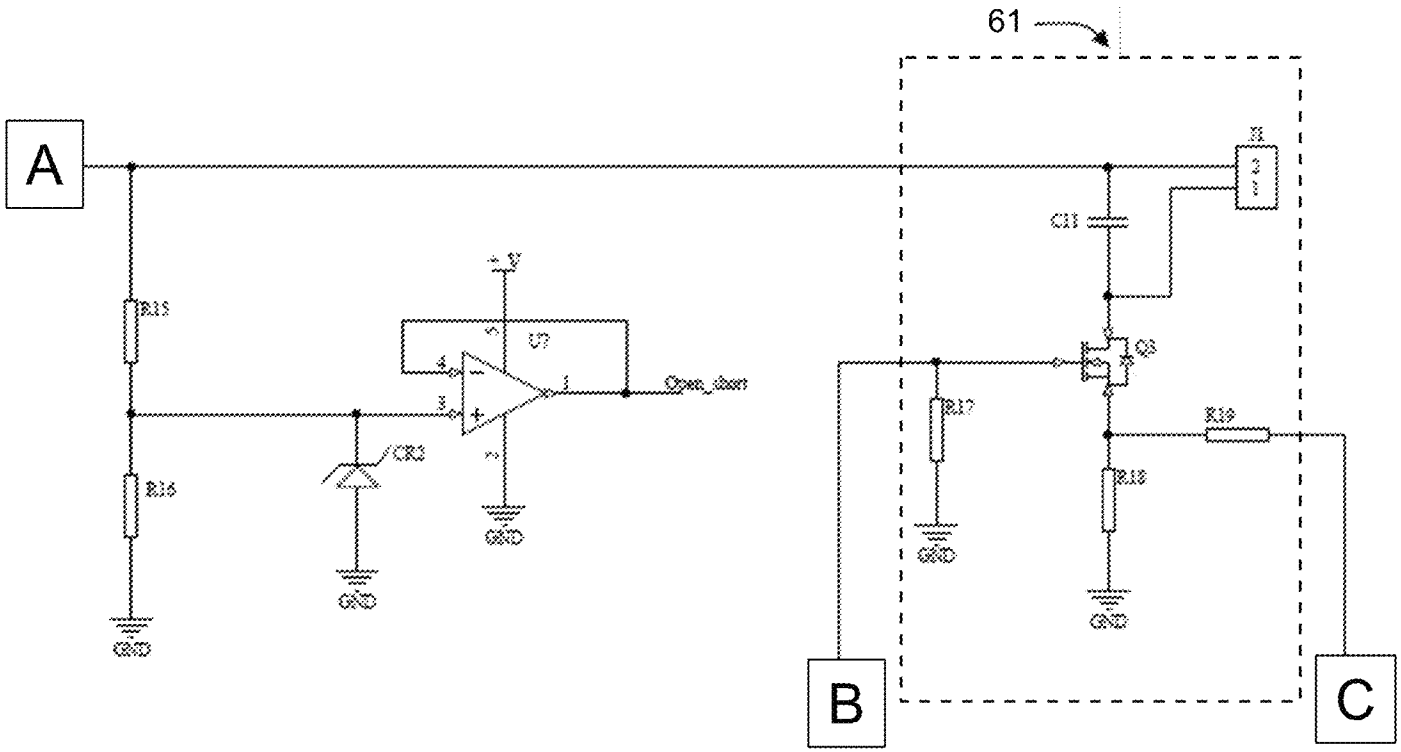
Figure 5C:
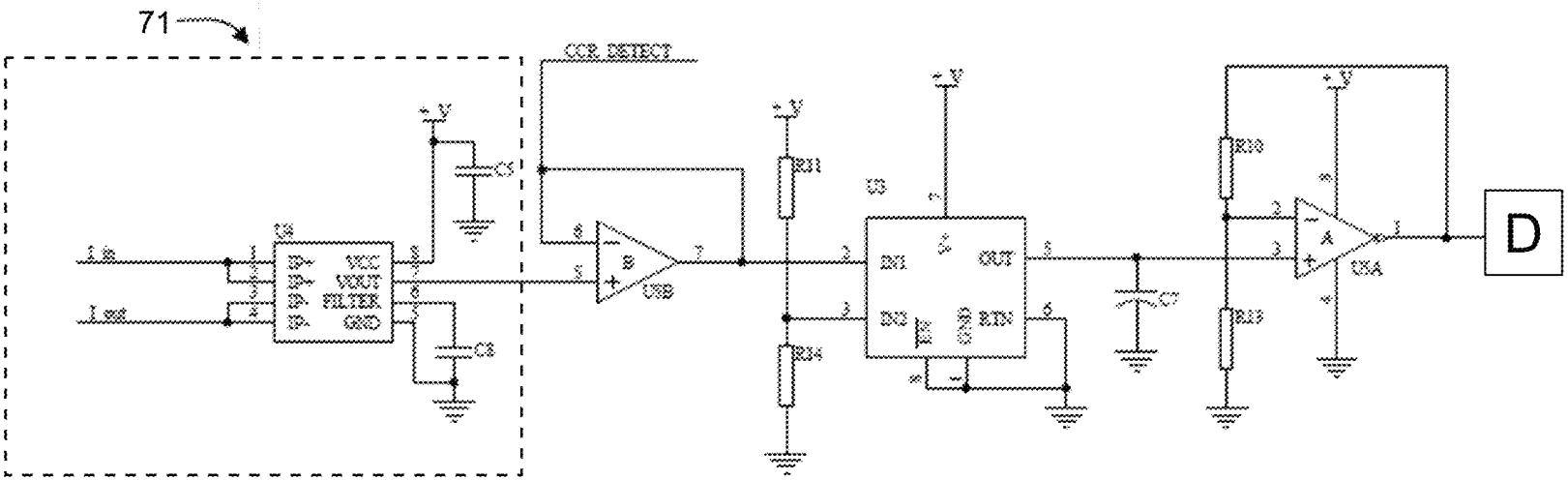
Figure 5D:
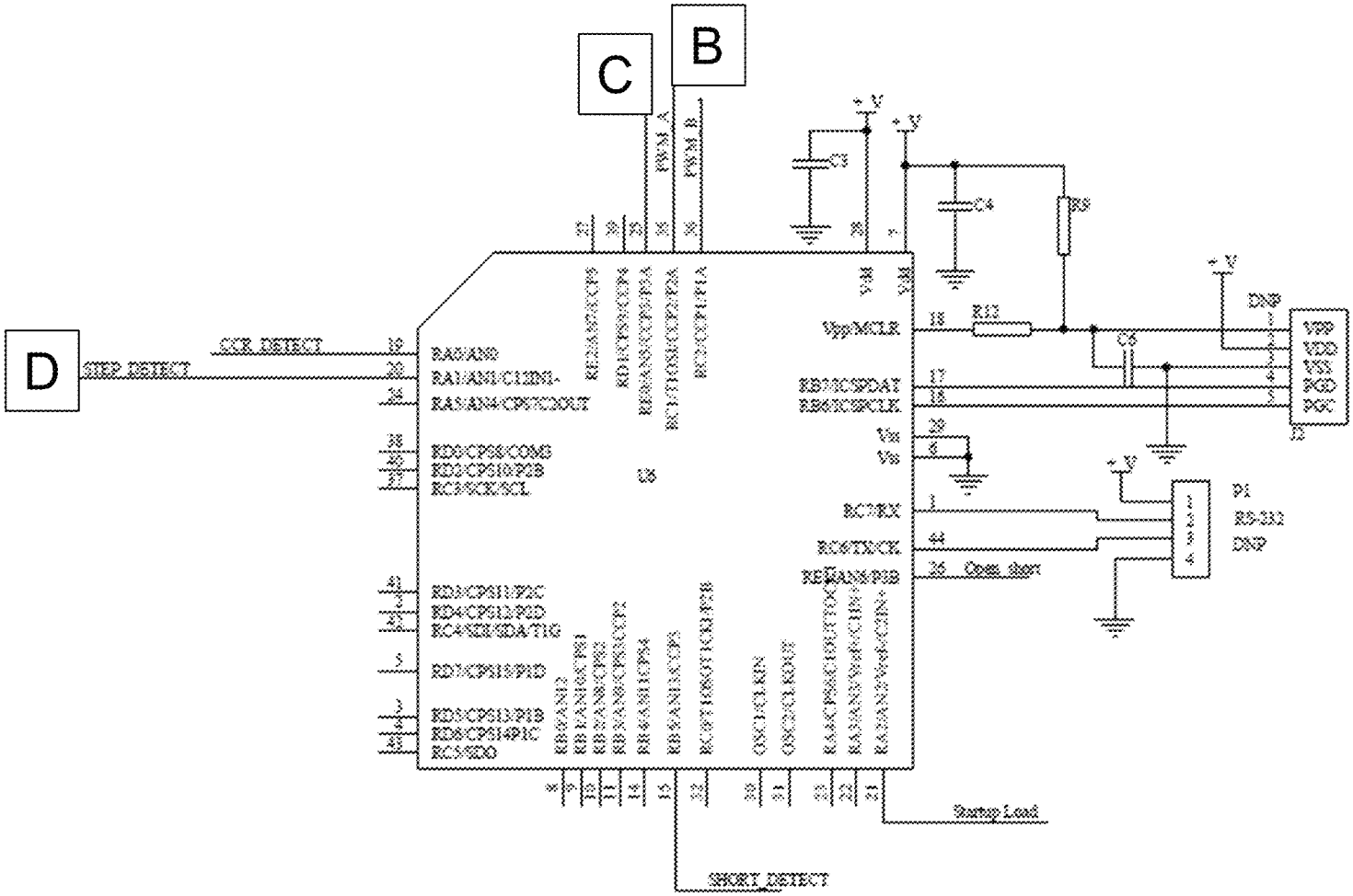
Figure 5E:
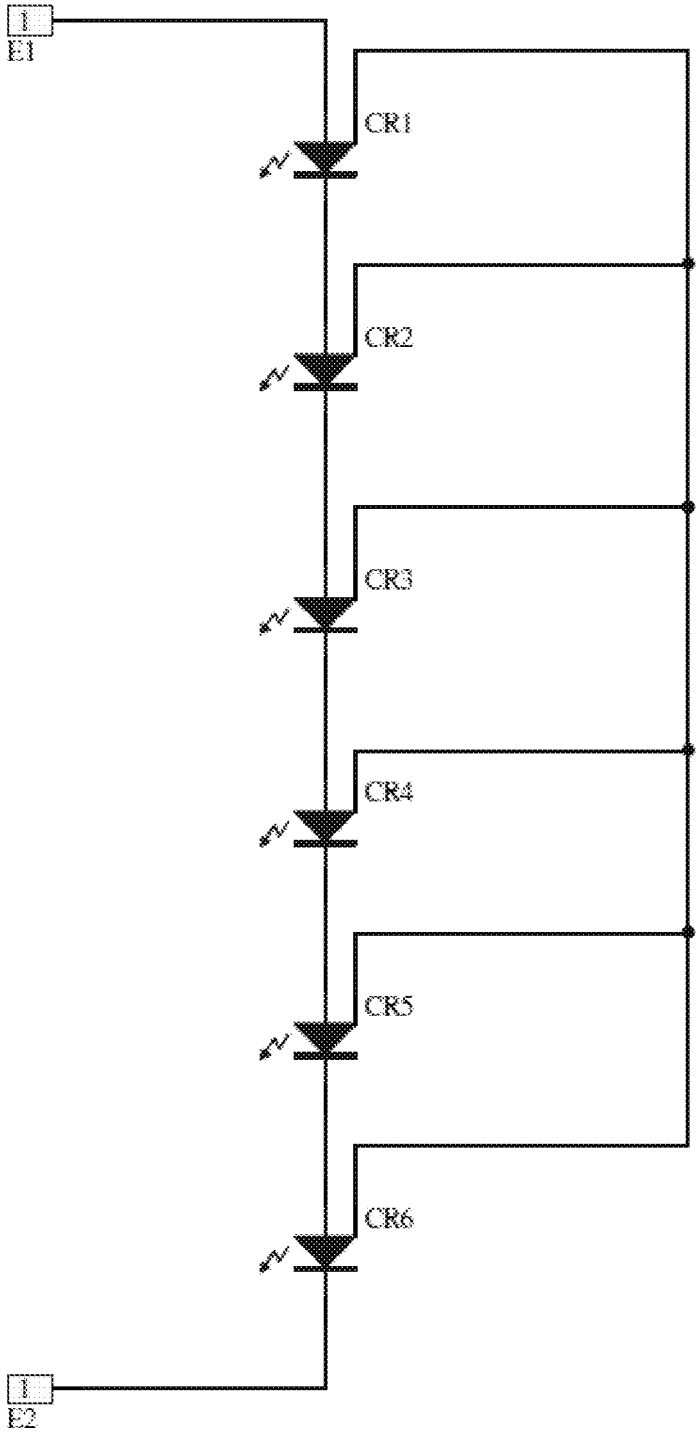

Circuit subsection 51 in FIG. 5A interfaces with one or more LEDs (see, for example, FIG. 5E). In this embodiment, LEDs are connected in series with node E1 and E2. Circuit subsection 51 may contain a varistor or fuse in parallel with the LED chain. Circuit subsection 51 may be in electronic communication with a linear current sensor shown in circuit subsection 71 of FIG. 5C.

Circuit subsection 53 in FIG. 5A interfaces with circuit subsection 51. Circuit subsection 53 comprises a MOSFET in communication with the microprocessor depicted in FIG. 5D. For example, the nodes labeled "PWM_B" and "Startup Load" may be connected to the respectively named nodes shown in FIG. 5D. The MOSFET and its associated components may be configured to prevent overdriving of the LEDs. Circuit subsection 53 also contains a diode, for example a Schottky diode. The diode may be configured so that the associated capacitors do not discharge during a short. Circuit subsection 55 comprises a voltage regulator connected to a +5V rail. The voltage regulator is configured to automatically maintain a constant voltage level.

Circuit subsection 61 in FIG. 5B reduces pulse-width modulation for low light output. A MOSFET may be used in order to achieve this goal. Pulse-width modulation may be used to encode the amplitude of a signal (here the level of light output) into the width of the pulse of another signal.

Circuit subsection 71 in FIG. 5C may be configured to sense current flow through the nodes labeled "I_in" and "I_Out." In one embodiment, the circuit subsection 71 may sense the current flow through the string of LEDs. Circuit subsection 71 may then convert the sensed current flow into a voltage which may be amplified and passed to the microprocessor in FIG. 5D. The microprocessor may measure the voltage received from circuit subsection 71 to determine if an LED failure has occurred. In some embodiments, the microprocessor may be able to determine how many LEDs have failed based on the voltage received from circuit subsection 71.

Figure 6:
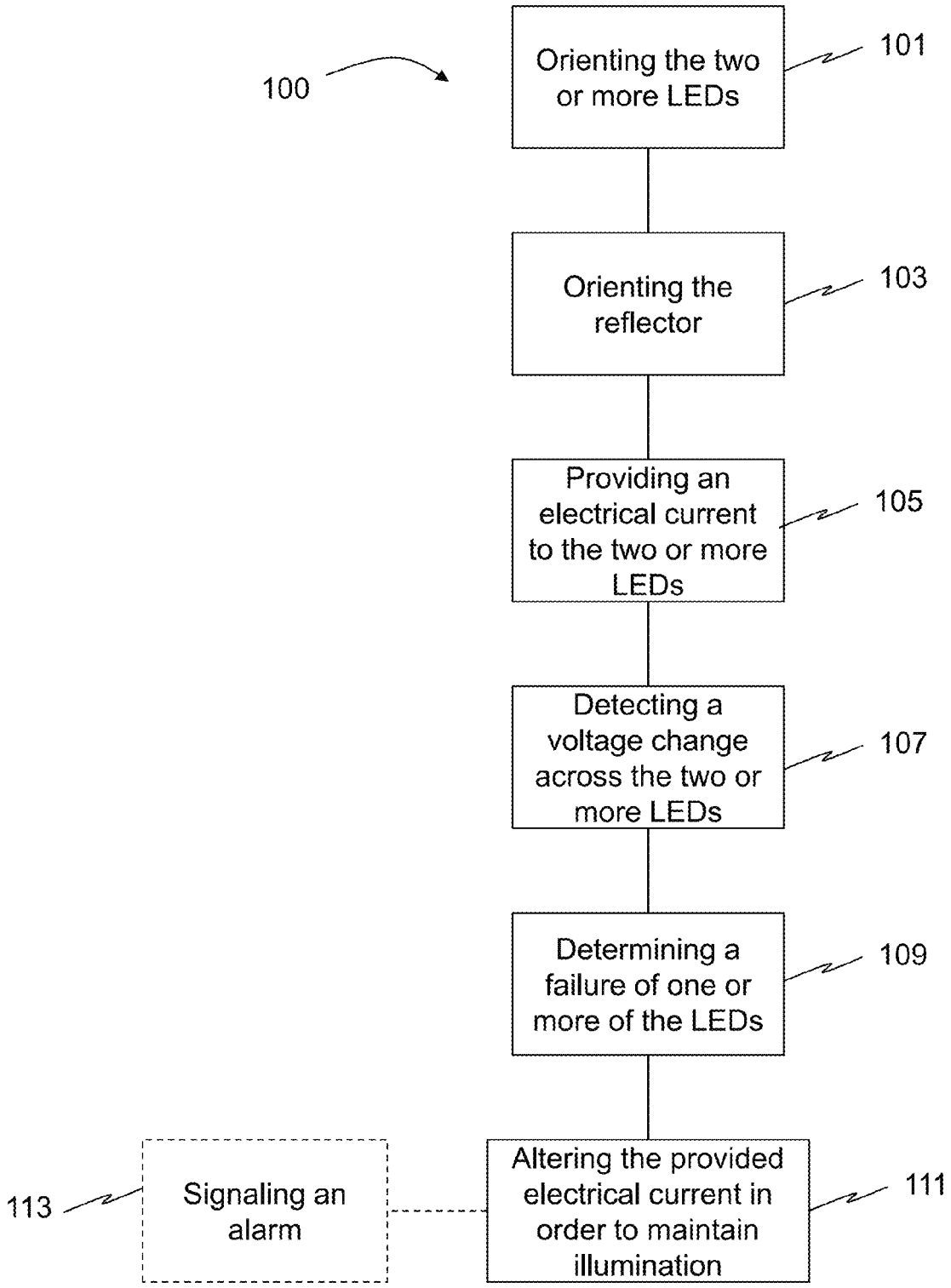
FIG. 6 is a flowchart of a method according to one embodiment of the present invention.

FIG. 6 depicts a flowchart of a method 100 according to the present invention. The method 100 is a method of maintaining illumination in an elevated light for an airfield. The elevated light has two or more serially-connected LEDs each having a primary illumination axis and a reflector. The method 100 comprises the step of orienting 101 the two or more LEDs such that the primary illumination axis of each LED is along a longitudinal axis of the elevated light. The method 100 further comprises the step of orienting 103 the reflector such that light emitted from each of the two or more LEDs is reflected radially with respect to the longitudinal axis of the elevated light. The method 100 further comprises the step of providing 105 an electrical current to the two or more LEDs using an LED driving circuit. The method 100 further comprises detecting 107, using a microprocessor, a voltage change across the two or more LEDs. The method 100 further comprises the step of determining 109, based on the voltage change, a failure of one or more of the LEDs. The method 100 further comprises the step of altering 111 the provided electrical current in order to maintain illumination in the elevated light after the failure of one or more of the LEDs. In one embodiment, the method 100 further comprises the step of signaling 113 an alarm when the failure of one or more of the LEDs is determined.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. An elevated light for an airfield, comprising:

a substrate having a mounting surface;

two or more light-emitting diodes ("LEDs") disposed on the mounting surface of the substrate and configured such that a primary illumination axis of each LED is oriented along a longitudinal axis of the elevated light, and wherein the two or more LEDs are serially connected with one another;

a reflector affixed to the substrate and having a reflecting surface configured such that the light emitted from the LEDs is reflected radially with respect to the longitudinal axis of the elevated light; and an LED driver circuit configured to provide a current to the LEDs and detect failure of one or more of the LEDs by detecting a voltage drop.

2. The elevated light of claim 1, further comprising a baffle arranged such that light from at least one of the LEDs is not directed to at least one other of the LEDs.

3. The elevated light of claim 2, wherein the baffle bisects the reflecting surface of the reflector.

4. The elevated light of claim 1, wherein at least one of the LEDs has a different chromaticity from that of another of the LEDs.

5. The elevated light of claim 1, further comprising an optically transmissive cover.

6. The elevated light of claim 1, wherein the two or more LEDs comprises six LEDs.

7. The elevated light of claim 1, wherein the reflector is affixed to the substrate substantially at a center of the substrate.

8. The elevated light of claim 1, wherein the reflecting surface is partially transmissive.

9. The elevated light of claim 5, wherein the cover is configured to filter light emitted from the LEDs.

10. The elevated light of claim 5, further comprising a baffle which conforms to the shape of an inside surface of the cover.

11. The elevated light of claim 1, wherein the LEDs are serially connected.

12. The elevated light of claim 11, wherein the LED driver circuit does not contain a voltage regulator, such that a rail voltage of the LED driver circuit varies as a function of the number of LEDs in the string and the forward voltage of each LED.

13. The elevated light of claim 11, wherein the LED driver circuit further comprises a MOSFET configured to ground the circuit in the case of an overvoltage condition.

14. The elevated light of claim 13, wherein the LED driver circuit further comprises one or more capacitors and a blocking diode between the MOSFET and the one or more capacitors.

15. The elevated light of claim 11, further comprising a series resistor, the series resistor configured to regulate an electrical current provided to the LEDs.

16. The elevated light of claim 13, further comprising an additional MOSFET positioned in series with the LEDs and configured to reduce a pulse-width modulation signal provided to the LEDs.

17. An elevated light for an airfield, comprising:

a substrate having a mounting surface;

six light-emitting diodes ("LEDs") disposed on the mounting surface of the substrate and configured such that a primary illumination axis of each LED is oriented along a longitudinal axis of the elevated light, and wherein the LEDs are serially connected with one another;

a reflector affixed to the substrate and configured such that the light emitted from the LEDs is reflected radially with respect to the longitudinal axis of the elevated light;

a baffle bisecting the reflecting surface of the reflector and arranged such that light from three of the LEDs having a first chromaticity is not directed to the other three LEDs having a second chromaticity; and an optically transmissive cover at least partially enclosing the LEDs, the reflector, and the baffle.

18. A method of maintaining illumination in an elevated light for an airfield, the elevated light having two or more serially-connected light-emitting diodes ("LEDs") each having a primary illumination axis and a reflector, the method comprising the steps of:

orienting the two or more LEDs such that the primary illumination axis of each LED is along a longitudinal axis of the elevated light;

orienting the reflector such that light emitted from each of the two or more LEDs is reflected radially with respect to the longitudinal axis of the elevated light;

providing an electrical current to the two or more LEDs using an LED driving circuit;

detecting, using a microprocessor, a voltage change across the two or more LEDs;

determining, based on the voltage change, a failure of one or more of the LEDs; and altering the provided electrical current in order to maintain illumination in the elevated light upon failure of one or more of the LEDs.

19. The method of claim 18, further comprising the step of signaling an alarm when the failure of one or more of the LEDs is determined.

* * * * *